US005212922A

United States Patent [19]

Werner

[11] Patent Number: 5,212,922

[45] Date of Patent: May 25, 1993

[54] KIT FOR GLASS FACADES

[76] Inventor: Günter Werner, Sieboldstr. 14, D-6100 Darmstadt, Fed. Rep. of Germany

[21] Appl. No.: 598,594

[22] PCT Filed: Apr. 18, 1989

[86] PCT No.: PCT/EP89/00413

§ 371 Date: Oct. 17, 1990

§ 102(e) Date: Oct. 17, 1990

[87] PCT Pub. No.: WO89/10461

PCT Pub. Date: Nov. 2, 1989

[30] Foreign Application Priority Data

Apr. 19, 1988 [DE] Fed. Rep. of Germany ... 8805126[U]
Aug. 18, 1988 [DE] Fed. Rep. of Germany ... 8810437[U]
Sep. 21, 1988 [DE] Fed. Rep. of Germany ... 8811937[U]

[51] Int. Cl.[5] ..... E04B 2/88

[52] U.S. Cl. ..... 52/235; 52/208; 52/475

[58] Field of Search ..... 52/235, 397, 399, 403, 52/208, 475, 463, 464

[56] References Cited

U.S. PATENT DOCUMENTS 3,940,897 3/1976 Stoakes ..... 52/397 X
3,956,863 5/1976 Tiedeken ..... 52/399
4,633,631 1/1987 Crandell ..... 52/399 X
4,837,996 6/1989 Eckelt ..... 52/235

FOREIGN PATENT DOCUMENTS 0223132 10/1986 European Pat. Off. .
2445202 4/1976 Fed. Rep. of Germany ..... 52/235
8714057 10/1987 Fed. Rep. of Germany .

*Primary Examiner*—Carl D. Friedman
*Assistant Examiner*—Robert Canfield
*Attorney, Agent, or Firm*—Burns, Doane, Swecker & Mathis

[57] ABSTRACT

A glass facade for a building comprises a support profile arrangement mounted on an outer surface of a building to form a facade substructure, and glass panes forming an outer surface of the facade and adhesively bonded to the support profile arrangement. Adjacently disposed ones of the glass panes include beveled edges which form joints. Anchoring bodies positively secure the glass panes to the support profile arrangement. The anchoring bodies grip the beveled edges of the glass panes and are releasably joined to said support profile arrangement. The anchoring bodies comprise cross-shaped anchoring crosses set into the intersection of four of the joints. Each anchoring cross includes a bushing extending substantially the entire depth of the anchoring cross. A screw extends into a countersunk hole formed in the bushing to secure the anchoring cross to the support profile arrangement.

16 Claims, 3 Drawing Sheets

FIG. 4
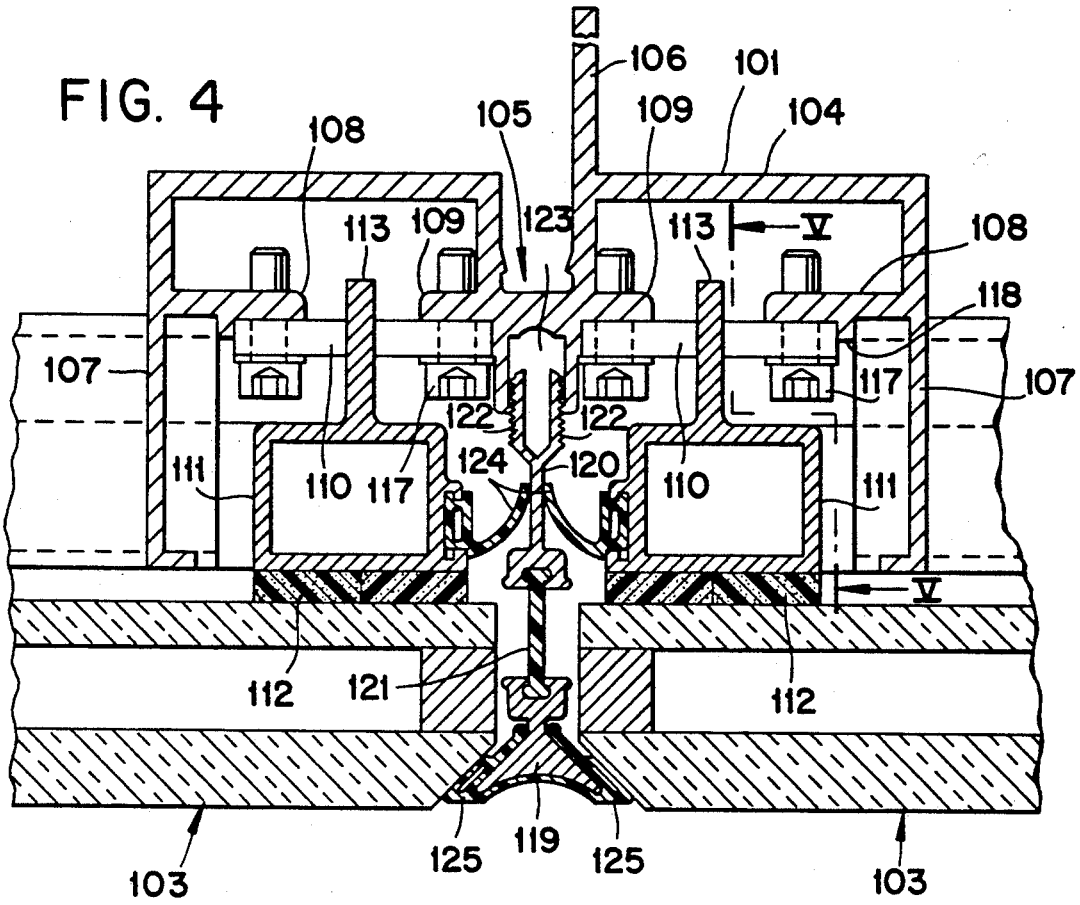
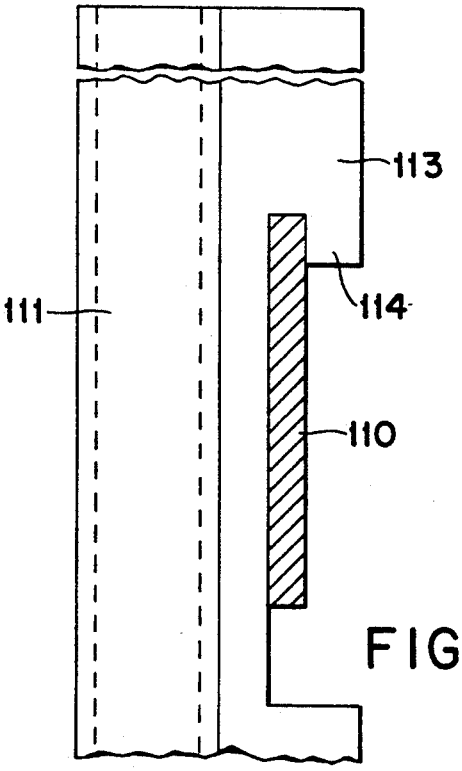
FIG. 5
FIG. 6
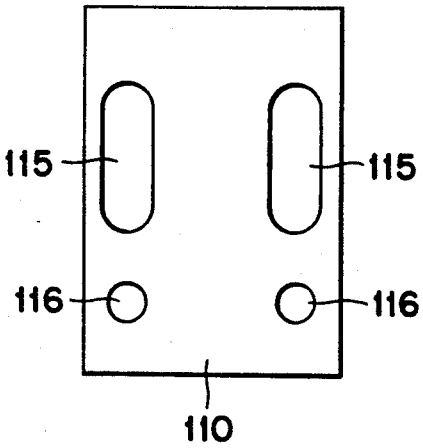

KIT FOR GLASS FACADES

BACKGROUND OF THE INVENTION

The invention concerns structural kit for a glass facade of a building, with supporting profiles capable of being mounted on the outer surface of the building to form a facade substructure and with glass panes forming the outer surface of the facade and equipped with retaining rails adhesively bonded at least to their two vertical edges on the inside and capable of interlocking with the support profiles, with the edges of the glass panes being beveled outward and interlocking anchoring elements being inserted in the joints between two adjacent glass panes, said anchoring elements gripping the beveled edges of the glass panes and being connected positively and releasably with the supporting profile.

Glass facades are generally being used increasingly both in new construction and in the renovation of older buildings. Primarily office buildings are being increasingly constructed with glass facades.

The glass facade may form the stressed skin of the building directly. In this case the substructure of the facade consisting of the support profiles is mounted on the outside of a load bearing building skeleton of steel profiles or reinforced concrete. If the glass facade is in the form of a thermal facade, insulating glass panes are customarily used.

To lockingly secure the glass panes, the retaining profiles joined to the substructure grip the panes around their edges. These retaining profiles therefore form a frame projecting beyond the outer surfaces of the glass panes, which, however, render the cleaning of the glass panes difficult and are less desirable for aesthetic reasons, as they divide the glass facade optically too extensively into a grid of individual glass panes.

In order to obtain a smooth outer surface of the facade desirable for aesthetic reasons and facilitating cleaning, from which no parts are projecting, it is known in the case of a glass facade originating in a structural kit of the aforementioned generic type (DOW CORNING), to mount the glass panes exclusively by means of the adhesively bonded retaining rails suspended from the facade substructure. The glass facade is thereby given an extensively smooth outer surface slightly held only by the joints between adjacent glass panes. However, for safety reasons, building authorities have not generally permitted such glass facades to date without positive locking. The objections essentially are due to the fact that no adequately secured information is available at this time relative to the behavior of the adhesive bond after extensive exposure in time to intensive environmental effects and solar radiation.

In certain cases such glass facades were permitted, but with the condition that an adequately large area be provided at the foot of the glass facade with no access by persons. In other cases, additional locking elements were specified, consisting of anchoring structural elements loosely gripping the edges of the glass panes in certain locations and joined to the substructure of the facade. However, these structural elements project from the outer surface of the facade and therefore interfere with the cleaning process and are aesthetically undesirable.

It is therefore the object of the invention to provide a structural kit for a glass facade of the aforementioned generic type, whereby a high strength, easily mounted and disassembled locking of the glass panels is assured.

This object is attained according to the invention by that the edges of the glass panes are beveled to the outside and an anchoring body positively securing the glass panes is inserted into the joints formed between adjacent glass panes, said anchoring body gripping the beveled edges of the glass panes and being positively and releasably interlocked with the support profile.

Additional joint profiles are preferably inserted between the anchoring crosses. In this manner, all of the joints formed between the glass panes are covered, so that an essentially tight glass facade is formed. This effect may be further reinforced by providing the arms of the anchoring crosses and the joint profiles on their lateral beveled edges in contact with the two edges of the glass panes with sealing strips. This elastic sealing strip is further intended to take up thermal expansions of the glass panes without stress. The glass facade according to the invention is suitable to form both a thermal and a cold facade. A glass facade as a cold facade is suspended at a distance from a building facade with windows and forms a supplemental thermal and acoustic insulation. In this form of embodiment suspended cold facade is particularly suitable for subsequent mounting on existing buildings, the existing facade of which remains essentially unchanged. The insulation obtained between the window panes prevents the loss of heat and in particular the penetration of dirt, rain water and snow.

In order to make possible the alignment of the glass pane suspension with simple means, in a further development of the invention each of the vertical retaining rails has on its side facing away from the glass pane at least one hooking element that may be suspended from a supporting part mounted in a height adjustable manner on the support panel.

This height adjustable mounting of the support part makes it possible to equalize deviations of the facade substructure due to manufacturing tolerances and mounting inaccuracies, so that the glass pane may be installed at the predetermined height and in an exactly vertical position on the facade substructure. As the supporting part is accessible from the outside as long as the glass pane is not in place, the supporting parts may be adjusted for example by means of a gage from the outside prior to the mounting of the pane. However, it is also possible to mount the pane, determine its deviation from the correct position, then remove the pane and adjust the supporting part to equalize the deviation of the glass pane determined.

The projecting suspension element preferably is in the form of a hook. The structural supporting part may according to a preferred embodiment of the invention be a vertical support plate placed parallel to the glass pane, that may be screwed onto the support profile. The hook of the suspending element then grips the upper edge of the support plate in a simple manner.

In an especially advantageous form of embodiment the support plate has at its two lateral edges which may be fastened to the support profile, an elongated vertical hole and a bore for a pin above each other. The support plate may be initially screwed onto the support profile through the two elongated holes. Subsequently, its position is gaged or the glass pane is hook on and its positional deviation determined. The screws of the support plate are then loosened, optionally after removing the glass pane, and the support plate displaced in the elongated holes until the height adjustment desired is obtained. After this, the support plate—possibly following the insertion and repeated removal of the glass pane for inspection—is fastened by the insertion of pins to the support profile, whereby the final, immobile height adjustment of the support plate is completed.

BRIEF DESCRIPTION OF THE DRAWINGS

The invention will become more apparent from examples of embodiment with reference to the drawing, in which:

FIG. 4 in a section similar to FIG. 1 a modified form of embodiment of a facade as a thermal face;

FIG. 5 a partial section on the line V—V in FIG. 4; and

FIG. 6 a top view of the support plate used in FIG. 4.

DETAILED DESCRIPTION OF A PREFERRED EMBODIMENT OF THE INVENTION

Figure 1:
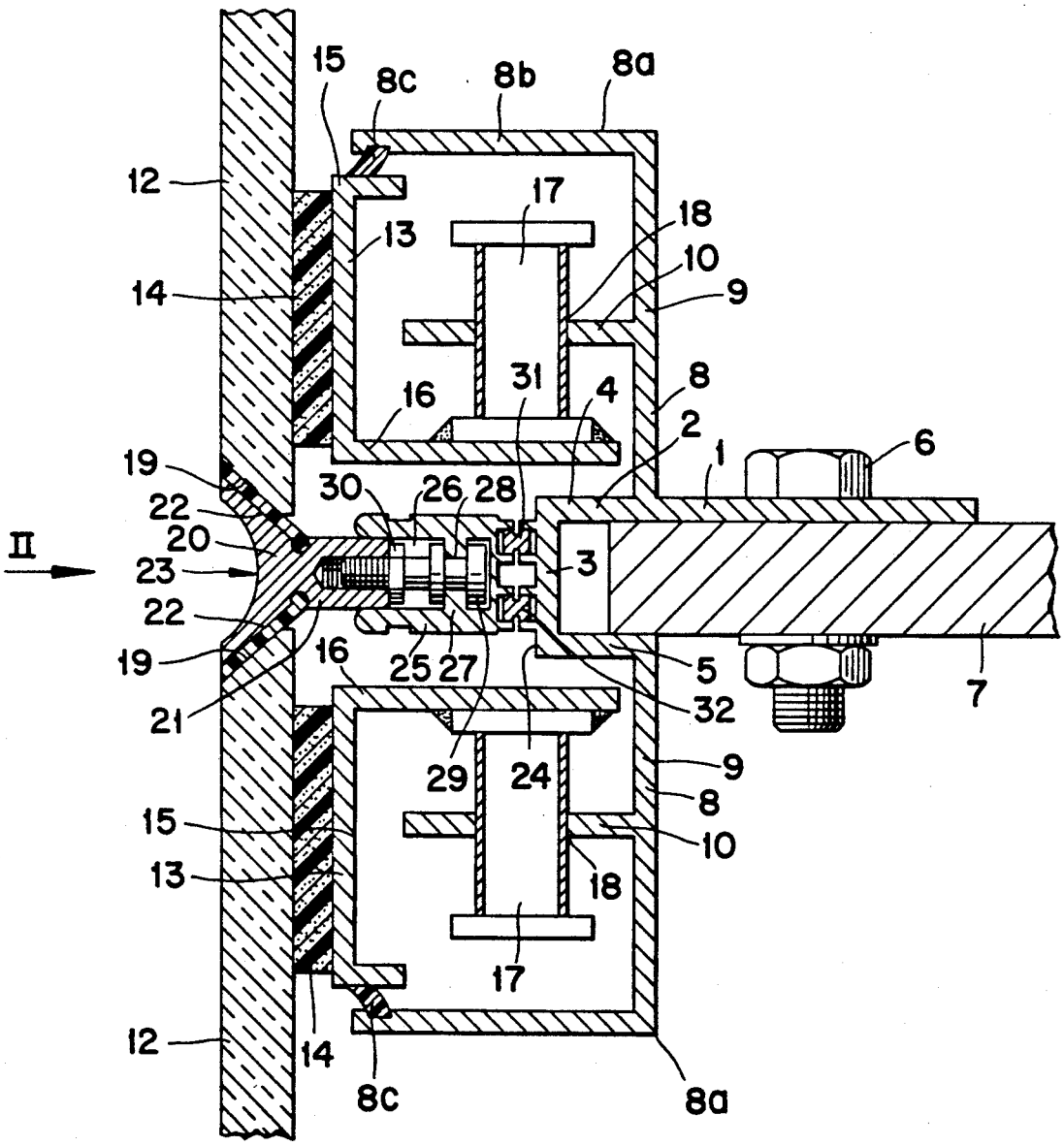
FIG. 1 shows a partial horizontal section of a glass facade in the form of a cold facade.

The glass facade consisting of the structural kit according to the invention, in the form of a cold facade for a building, the essential parts of which are shown in FIG. 1, comprises a facade substructure consisting of support profiles 1, wherein the support profiles 1 are located along the edges of glass panes vertically and horizontally. FIG. 1 shows a section through a vertical support profile 1.

The support profile 1 forms in its cross section a U-shaped center segment 2, comprising an outer web surface 3 and two inwardly directed legs 4, 5. One leg 4 is extended farther inward relative to the other leg 5 and is fastened by means of screws 6 laterally to a vertical support bracket 7, which in turn is mounted on the one hand on the outer wall of the building (not shown), and on the other, projects into the U-shaped center segment 2. The support bracket 7 may also be part of the supporting skeleton of a building.

From each of the inner ends of the legs 4 and 5 of the U-shaped center segment an angle rail 8 is extending, the inner angle leg 9 of which extends parallel to the facade surface, while the other leg 10 is directed perpendicularly outward.

The glass panes 12 forming the outer surface 11 of the facade are provided at least at the two vertical edges inside with adhesively bonded retaining rails 13. Between the retaining rail 13 and the glass pane 12 a permanently elastic adhesive layer 14 is provided. The retaining rail 13 has an angle leg 15 adhesively boded to the glass pane 12 and an angle leg 16 extending perpendicularly inward from said leg 16.

On the angle leg 16 spaced apart hanger bolts 17 are mounted over each other, preferably by welding, said hanger bolts being inserted in the hanger slots 18 of the angle leg 10 of the support profile 1. These hanger slots 18 extend vertically in the angle legs 10 and are outwardly open at their upper end, so that the glass panes 12 joined to the hanger bolts 17 may be suspended from them.

As seen in FIG. 1, the hanger bolts 17 of the two vertical edges of each of the glass panes 12 are facing each other. The angle legs 16 of the retaining rails 13 lock into the outwardly open space behind the angle legs 10.

On the outer side of the two angle rails 8 another angle rail 8*a* is provided in a single piece with it, with its outer angle leg 8*b* extending parallel to the angle leg 10 and spaced apart from it and covering the ends of the hanger bolts 17. The outer edge of the angle leg 8*b* is sealed by means of a sealing lip 8*c* against the edge of the retaining rail 13.

The vertical and horizontal edges 19 of the glass panes 12 are beveled to the outside, for example at an angle of 45°, as shown in the drawing. An essentially V-shaped joint profile 20 grips the beveled edges 19, but without projecting from the outer surface 11 of the glass panes 12. The V-shaped joint profile 20 is joined at its apex in an angle piece with an inwardly extending rib 21.

The joint profile 20 has on its outer side a flat elongated groove 23 extending over a substantial part of the width of the joint profile 20.

Figure 2:
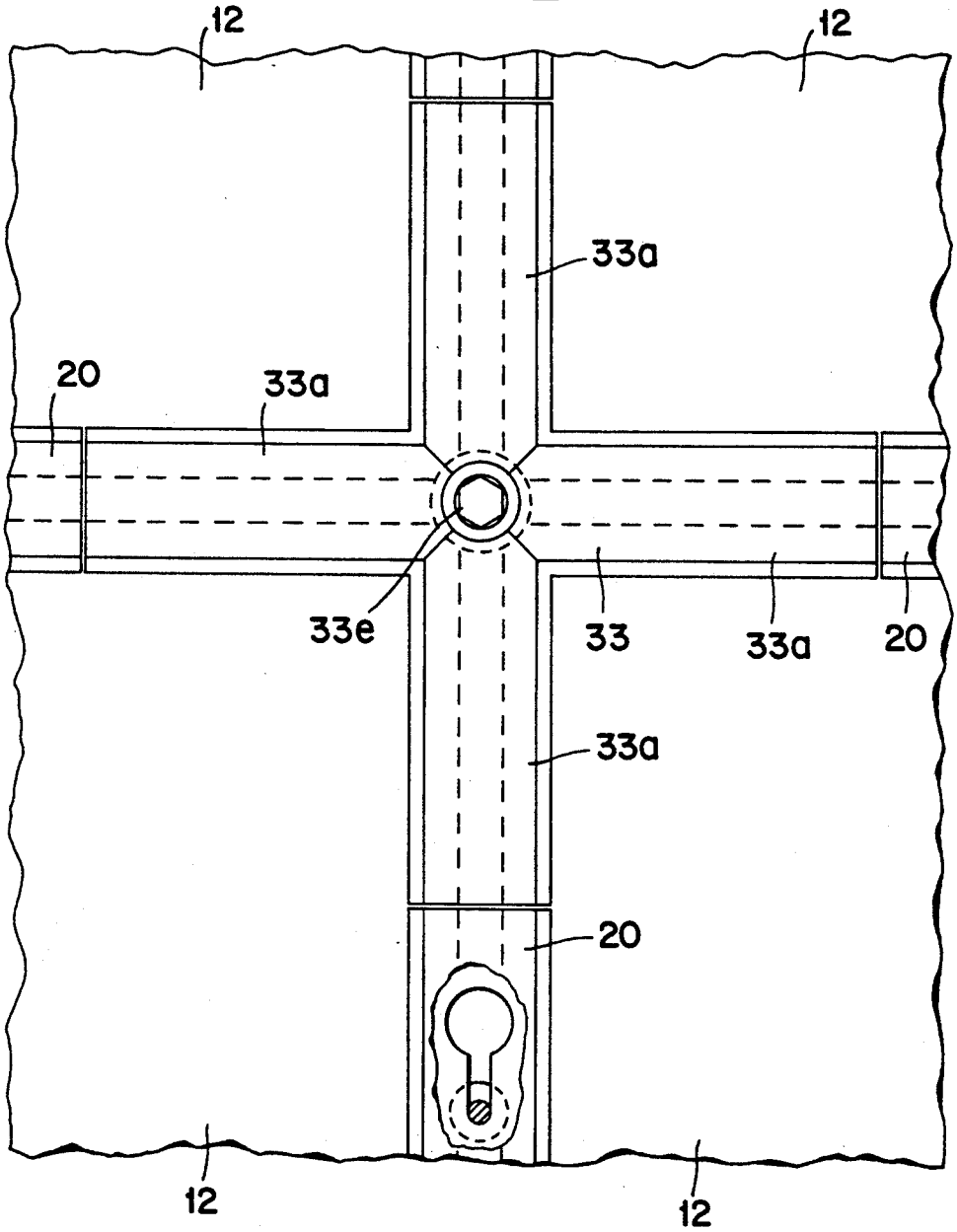
FIG. 2 a view in the direction of the arrow II in FIG. 1 in the intersection of the joints between the glass panes.

On the frontal surface 24 of the web surface 3 a profiled rail 25 is mounted; it forms an outwardly open channel 26, into which the rib 21 is projecting. The bottom of the channel 26 is formed by a web wall 27 comprising a plurality of keyhole shaped hanger openings 28. Head bolts 29 screwed from behind into the rib 21 are inserted into the hanger openings 28, as shown in FIG. 2. The threaded shaft of the head bolts 29 may be screwed to the depth desired into the rib 21 to align the joint profiles 20, and may be secured in this position by a lock nut 30.

The profile rail 25 and the web surface 3 are connected preferably by means of plastic thermally insulative connecting elements 31 in the form of sliding blocks or vertical strips, which engage undercut retaining grooves 32 in the facing surfaces of the profile rail 25 and the web surface 3.

At the intersections (FIG. 2) of the joints formed between adjacent joint profiles, an anchoring cross 33 is inserted, having beveled lateral surfaces 33*e*, gripping the beveled edges 19 of the glass panes 12. Each anchoring cross is positively and releasably connected with the support profile 1, preferably screwed on. The arms 33*a* of the anchoring cross 33 are approximately V-shaped in cross section and are connected at their apex in a single piece with a rib 33*b* projecting inward.

Figure 3:
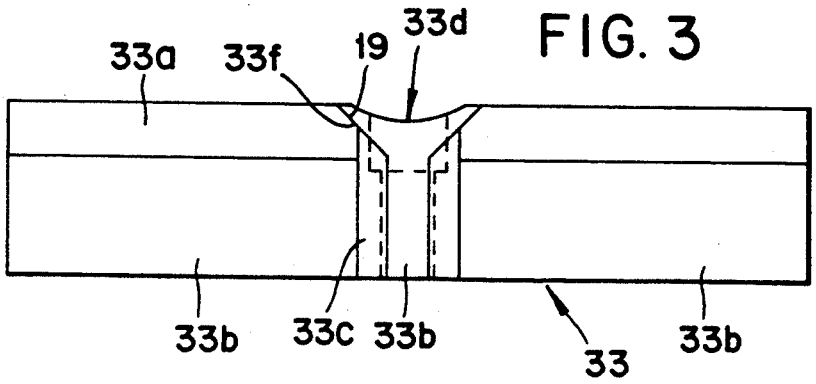
FIG. 3 a lateral elevation of an anchoring cross.

At the intersection the ribs 33*b* are joined in single piece with a bushing 33*c* extending over the entire depth of the anchoring cross 33 and preferably to the support profile 1 (FIG. 3). In a center threaded bore 33*d* countersunk on the outside, a screw 33*e* is located, the head of which is countersunk and which is screwed into the support profile 1.

The anchoring crosses 33 are forming the positive lock of the glass panes 12, while the joint profiles 20 essentially only close the joints between the glass panes 12. The anchoring crosses 33 also prevent any unintentional unhooking of the joint profiles 20.

The joint profiles 20 and the arms 33*a* of the anchoring crosses 33*e* carry elastic sealing strips 22, for example of an elastomeric material, on their lateral beveled edges 19 gripping the glass panes 12. In this manner, the adjacent edges 19 are sealed off of each other, so that the entirety of the glass panes 12 of the facade form an essentially tight surface.

The anchoring crosses 33 may be installed following the suspension of the glass panes 12 and may be released for the removal of a glass pane, for example in case of damage.

However, the positive locking of the glass panes 12 may also be obtained by means of the joint profiles 20, if —as shown in FIG. 1—they are in the form of elongated anchoring profiles 20.

The example of a thermal facade according to FIG. 4 comprises a facade substructure consisting of vertical support profiles 101 and horizontal support profiles 102. The support profiles 101 and 102 are located behind the joints of glass panes 103, which in the present example consist of insulating glass with double panes. Instead of transparent panes, opaque panes, for example enameled glass panes or the like, may also be used.

The support profile 101 comprises on its rear side facing the inside of the building a rear wall 104, interrupted by an outwardly offset center piece 105. A leg 106 projects inwardly from the rear wall 104 to secure it on the building.

The support profile 101 altogether forms a trough open to the outside, in which vertical shoulders 108, 109 project against each other from the lateral walls 107 and the center segment 105, said shoulders extending parallel to the plane of the glass panes 103. Support parts in the form of support plates 110 are screwed with their vertical edges onto the mutually projecting shoulders 108, ending at a distance from each other.

The glass panes 103 forming the outer surfaces of the facade are provided on the inside of their vertical edges with an adhesively bonded retaining rail 111. In the example shown the retaining rail 111 is in the form of a rectangular hollow profile. A permanently elastic adhesive layer 112 is placed between the retaining rail 111 and the glass pane 103.

From the rear side of the retaining rail 111 a suspension element in the form of a vertical web strip 113 is projecting in a single piece with it. As seen in FIG. 5, the strip 113 is notched so that it forms for example a downwardly open hook 114, which in the inserted state overlaps the upper edge of the support plate 110.

The support plate 110 shown in FIG. 6 in a front elevation, comprises at its two lateral edges a vertical elongated hole 115 and a stud hole 116. The support plates 110 are mounted by means of fastening screws 117 projecting through the elongated holes 115 on the vertical shoulders 108, 109 in a height adjustable manner.

For the lateral guidance of the support plates 110, ribs 118 may protrude outward from the shoulders 108. On the other side the support plates 110 are guided by the projecting walls of a retaining groove 123 on the center part 105.

The elongated holes 115 make it possible to adjust the retaining plates 110 on the screws 117. For the final, stationary mounting of the support plates 110, holes are drilled through the stud holes 116 into the shoulders 108, 109 following their adjustment in height and the plates 110 fastened by pins through said holes.

A joint profile 119 placed between the adjacent, outward beveled edges of the glass panes 103 is provided over its entire length with an inwardly projecting strip 120, which may contain a thermally insulating plastic center piece 121, so that it does not form a thermal bridge. The strip 120 has two spaced apart retaining lips 122, which lock with their serrated outer side into the retaining groove 123.

The two retaining rails 111 carry on their mutually facing lateral surfaces facing the adjacent glass pane 103 a projecting sealing lip 124, which in the assembled state is bent over and is abutting against the strip 120 of the joint profile 119. In this manner, and optionally by an elastic sealing layer 125 on the edges of the joint profile 119, the adjacent glass plates 103 are sealed in the area of the joints.

The configuration in the area of the horizontal joints between the glass panes 103 is similar. However, here the retaining rails 126 adhesively bonded to the horizontal edges of the glass panes 103 have no projecting strip on their rear side.

I claim:

1. In a glass facade for a building comprising a support profile arrangement mounted on an outer surface of a building to form a facade substructure, and glass panes forming an outer surface of said facade and adhesively bonded to said support profile arrangement; adjacently disposed ones of said glass panes including beveled edges which form joints; anchoring bodies being provided for positively securing said glass panes to said support profile arrangement; said anchoring bodies gripping said beveled edges of said glass panes and being releasably joined to said support profile arrangement, said anchoring bodies comprising cross-shaped anchoring crosses set into the intersection of four of said joints, each anchoring cross including a bushing extending substantially the entire depth of said anchoring cross, a hole extending through said bushing, said hole being countersunk on an outside surface of said anchoring cross, and a screw extending into said hole and secured to said support profile arrangement.

2. Apparatus according to claim 1, wherein each of said anchoring crosses includes beveled lateral surfaces opposing respective beveled edges of said glass panels, sealing strips being interposed between each beveled lateral surface and its respective beveled edge.

3. Apparatus according to claim 1, wherein each of said anchoring crosses includes arms, each of said arms having an outer portion of generally V-shape cross section and a rib extending inwardly from said outer portion.

4. Apparatus according to claim 1, wherein each of said anchoring crosses includes arms, each of said arms including an outer side having an elongated groove extending parallel to its respective arm.

5. Apparatus according to claim 1, wherein each of said anchoring crosses includes arms which are of one-piece construction with said bushing, said arms and bushing having the same depth.

6. Apparatus according to claim 1 including joint profiles extending along said joints between said anchoring crosses, said joint profiles engaging said beveled edges and being attached to said support profile arrangement.

7. Apparatus according to claim 6 including strips of thermally insulative material arranged to connect said joint profiles with said support profile arrangement.

8. Apparatus according to claim 6 including a vertical shoulder strip projecting inwardly from each joint profile, said support profile arrangement including retaining grooves receiving inner ends of respective shoulder strips.

9. Apparatus according to claim 8, wherein said support profile arrangement includes mutually facing lateral surfaces disposed on opposite sides of each vertical strip, a sealing lip extending between each of said lateral surfaces and a respective side of said vertical strip.

10. In a glass facade for a building comprising a support profile arrangement mounted on an outer surface of a building to form a facade substructure, and glass panes forming an outer surface of said facade and adhesively bonded to said support profile arrangement; adjacently disposed ones of said glass panes including beveled edges forming joints; anchoring bodies being provided for positively securing said glass panes to said support profile arrangement; said anchoring bodies gripping said beveled edges of said glass panes and being releasably joined to said support profile arrangement, said anchoring bodies comprising cross-shaped anchoring crosses set into the intersection of four of said joints, said support profile arrangement including a plurality of retaining rails to which said portions of said glass panes are adhesively bonded, each of said retaining rails including a suspension element projecting in a direction away from said glass panes, a support part connected to said suspension element and vertically adjustably connected to said support profile arrangement.

11. Apparatus according to claim 10, wherein said suspension element includes a hook-shaped portion connected to said support part.

12. Apparatus according to claim 11, wherein said support part comprises a support plate arranged parallel to said glass panes, said hook-shaped portion gripping an upper edge of said support plate.

13. Apparatus according to claim 12, wherein said support plate includes vertically elongated slots, screws extending through said slots and into said support profile arrangement.

14. Apparatus according to claim 13, wherein said support plate includes stud holes through which fasteners can extend to non-adjustably connect said support plate to said support profile arrangement.

15. Apparatus according to claim 14, wherein said support profile arrangement includes an outwardly open trough and two vertical shoulder disposed therein, said strips being spaced apart horizontally, said elongated slots and said stud holes in said support plate being disposed in front of respective ones of said strips.

16. Apparatus according to claim 11, wherein said support plate includes a vertical strip projecting in a direction away from said glass panes and forming said hook-shaped portion.

* * * * *